US007776502B2

(12) United States Patent
Fukushima et al.

(10) Patent No.: US 7,776,502 B2
(45) Date of Patent: Aug. 17, 2010

(54) TONER FOR DEVELOPING ELECTROSTATIC CHARGE IMAGE, ELECTROSTATIC CHARGE IMAGE DEVELOPER, IMAGE FORMING METHOD AND IMAGE FORMING APPARATUS

(75) Inventors: Norihito Fukushima, Kanagawa (JP); Rieko Kataoka, Kanagawa (JP); Sakon Takahashi, Kanagawa (JP); Toshiyuki Yano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 402 days.

(21) Appl. No.: 11/790,652

(22) Filed: Apr. 26, 2007

(65) Prior Publication Data

US 2008/0102396 A1 May 1, 2008

(30) Foreign Application Priority Data

Nov. 1, 2006 (JP) ..... 2006-297233

(51) Int. Cl.
*G03G 9/087* (2006.01)

(52) U.S. Cl. ..... 430/109.5; 430/125.3; 399/130

(58) Field of Classification Search ..... 430/109.5, 430/125.3; 399/130
See application file for complete search history.

(56) References Cited

U.S. PATENT DOCUMENTS

| | | | | |
|---|---|---|---|---|
| 5,849,456 | A | 12/1998 | Matsumura et al. | |
| 6,890,696 | B2 | 5/2005 | Farrugia et al. | |
| 7,169,526 | B2 * | 1/2007 | Ishikawa et al. | 430/110.1 |
| 7,510,811 | B2 * | 3/2009 | Matsumura et al. | 430/108.1 |

FOREIGN PATENT DOCUMENTS

| | | |
|---|---|---|
| JP | A 49-91231 | 8/1974 |
| JP | A 59-40868 | 4/1981 |
| JP | B2 3141783 | 12/2000 |
| JP | A 2004-286820 | 10/2004 |
| JP | A 2004-354993 | 12/2004 |
| JP | A 2005-128073 | 5/2005 |
| JP | A 2006-30806 | 2/2006 |

* cited by examiner

*Primary Examiner*—John L Goodrow
(74) *Attorney, Agent, or Firm*—Oliff & Berridge, PLC

(57) ABSTRACT

A toner for developing an electrostatic charge image, includes: a binder resin formed by reacting a polymerizable aromatic monomer having an ethylenically unsaturated double bond conjugated to an aromatic ring thereof, a nitrogen-containing polymerizable aliphatic monomer having an ethylenically unsaturated double bond and a sulfur-containing aliphatic compound to each other; and a colorant, wherein a ratio (MN/MS) of an amount of nitrogen (MN) to an amount of sulfur (MS) is in a range of from 1.0 to 15.

19 Claims, No Drawings

TONER FOR DEVELOPING ELECTROSTATIC CHARGE IMAGE, ELECTROSTATIC CHARGE IMAGE DEVELOPER, IMAGE FORMING METHOD AND IMAGE FORMING APPARATUS

CROSS-REFERENCE TO RELATED APPLICATION

This application is based on and claims priority under 35 USC 119 from Japanese Patent Application No. 2006-297233 filed Nov. 1, 2006.

BACKGROUND

1. Technical Field

The present invention relates to a toner for developing electrostatic charge image and an electrostatic charge image developer which can be used in electrophotographic devices (image forming apparatus) employing an electrophotographic process such as a copying machine, a printer, a facsimile, and the like.

2. Related Art

A method of visualizing image information through an electrostatic charge image such as an electrophotographic method is used in various fields at present. In the electrophotographic method, an electrostatic charge image is formed on a photoreceptor by a charging and exposing process, developed by the use of a developer containing a toner, and visualized through a transferring and fixing process. As for the developer used herein, a two components developer containing a toner and a carrier, and a monocomponent developer containing a magnetic toner or non-magnetic toner alone have been known.

A toner for developing an electrostatic charge image is required to have electrical characteristics. In an electrophotographic system, it is widely known that various properties, for example, a charging amount to the photoreceptor in the charging process, a transferring current in the transferring process, and the like are determined according to an amount of static electricity generated in a toner. Accordingly, it is preferred that a variation in the amount of static electricity (which may be referred to as a charging amount) generated in the toner according to a variation in the environment such as temperature and humidity of the surroundings, a variation in time due to a continuous stirring, or a variation due to difference in charging characteristic between the previously charged toner and a toner newly added thereto is small as possible.

SUMMARY

According to an aspect of the invention, there is provided a toner for developing an electrostatic charge image, the toner including: a binder resin formed by reacting a polymerizable aromatic monomer having an ethylenically unsaturated double bond conjugated to an aromatic ring thereof, a nitrogen-containing polymerizable aliphatic monomer having an ethylenically unsaturated double bond and a sulfur-containing aliphatic compound to each other; and a colorant, wherein a ratio (MN/MS) of an amount of nitrogen (MN) to an amount of sulfur (MS) is in a range of from 1.0 to 15.

DETAILED DESCRIPTION

Hereinafter, the invention will be described in detail.

<Toner for Developing Electrostatic Charge Image>

A toner for developing an electrostatic charge image (hereinafter, simply referred to as a 'toner') of the invention includes a binder resin formed by allowing a polymerizable aromatic monomer having an ethylenically unsaturated double bond conjugated to an aromatic ring thereof (hereinafter, simply referred to as a 'polymerizable aromatic monomer'), a nitrogen-containing polymerizable aliphatic monomer having an ethylenically unsaturated double bond (hereinafter, simply referred to as a 'nitrogen-containing polymerizable aliphatic monomer'), and a sulfur-containing aliphatic compound to react with each other; and a colorant, in which the ratio (MN/MS) of an amount of nitrogen (MN) to an amount of sulfur (MS) is in the range of from 1.0 to 15. In addition, the toner may include other components such as a release agent and the like, if necessary.

The toner for developing an electrostatic charge image of the invention can control a variation in charging amount due to an environment variation and provide an excellent image having small fog.

In the related art, for a resin composition of a toner used in a wet type production method accompanying a shape control, polymers of polymerizable monomers having an ethylenically unsaturated double bond by styrene, methacrylate ester, and the like have been used from a viewpoint of easy control of molecular weight and glass transition temperature. In general, the polymerizable monomer having an ethylenically unsaturated double bond conjugated to an aromatic ring such as a phenyl group is polymerized faster than the aliphatic series having the general an ethylenically unsaturated double bond. This is because a $\pi$ electron of the aromatic ring is conjugated and the monomer is stabilized so that activation energy required for a polymerization reaction is lower than that of the aliphatic series having the general an ethylenically unsaturated double bond. As a result, in these copolymers, there are larger numbers of copolymers formed of the polymerizable monomers having an ethylenically unsaturated double bond conjugated to an aromatic ring thereof than the primary copolymerization ratio in the early stage of the polymerization reaction. The polymers are formed to have a fiber-ball shape in order to decrease entropy in molecular chains as molecular weight of the formed polymer increases and then the polymerization is completed.

On the contrary, in the late stage of the polymerization reaction, there are larger numbers of copolymers formed of the aliphatic series than the primary copolymerization ratio and the copolymers can be more easily existed on the surface as compared with the polymers having more aromatic series. In addition, the sulfur-containing aliphatic compound adjusts molecular weight thereof to some extent by properly controlling the polymerization reaction. However, the reaction is slowly carried out because the compound has the aliphatic series and the adjustment of the molecular weight may be easily acted as a more competitive reaction against the polymerizable aliphatic monomers. As a result, for example, when the nitrogen-containing polymerizable aliphatic monomer is used to positively charge the toner, nitrogen and sulfur are easily coexisted with each other near the surface. Therefore, sulfur may cause deterioration of positive charging characteristic which nitrogen primarily has and reduce difference in charging amount due to the surrounding environment. In particular, the above-mentioned tendency is strongly shown in a reaction conducted by the use of a water-based medium such as emulsion polymerization, suspension polymerization, or the like.

According to such properties, the toner of the invention uses the copolymer of polymerizable aromatic monomer and the nitrogen-containing polymerizable aliphatic monomer as a binder resin. In addition, the ratio (MN/MS) of an amount of nitrogen (MN) in the toner to an amount of sulfur (MS) in the toner is set to be in the range of from 1.0 to 15 in order to allow a nitrogen-containing group to be easily existed on the surface of the toner and obtain the toner having the positive charging characteristic of which charging characteristic is hardly influenced from the surrounding environment.

According to the toner of the invention, the ratio (MN/MS) of the amount of nitrogen (MN) in the toner to the amount of sulfur (MS) in the toner is preferably in the range of from 2.0 to 10, more preferably in the range of from 5 to 10. When the ratio is in such a range, an excellent image having small fog can be obtained.

According to the toner of the invention, the ratio (MN/MS) of the amount of nitrogen (MN) in the binder resin to the amount of sulfur (MS) in the binder resin is preferably in the range of from 1.0 to 10, more preferably in the range of from 2.0 to 10, further preferably in the range of from 5 to 10.

For a method of measuring MN, MS, and MN/MS in the toner or the binder resin, the well-known analysis methods may be used. However, it is preferred to analyze them in accordance with a fluorescence X-ray measurement method.

As for one example of the fluorescence X-ray measurement method, there can be exemplified a measurement method in which 6 g of a toner is subjected to a pressure molding under conditions of 10 t of pressure for one minute by the use of a pressure molding machine for pre-treatment of a sample, and then the pre-treated sample thus obtained is subjected to a measurement under measurement conditions of 40 KV of tube voltage and 90 mA of tube current for 30 minutes of measurement time by the use of fluorescence X-ray (XRF-1500) manufactured by Shimadzu Corporation.

Volume average particle diameter of the toner is preferably in the range of from 2 to 10 μm, more preferably in the range of from 3 to 8 μm, further preferably in the range of from 5 to 7 μm. It is preferred to have a narrow toner particle size distribution, more specifically, it is preferred that a value (number average particle size distribution index: GSDp) which the toner of which number particle diameter is small is firstly converted and then the ratio of 16% diameter (abbreviated as $D_{16p}$) and 84% diameter (abbreviated as $D_{84p}$) is represented as a square root, that is, GSDp represented as the following formula is 1.40 or below, more preferably 1.31 or below, most preferably in the range of from 1.20 to 1.27.

$$GSDp=\{(D_{84p})/(D_{16p})\}^{0.5}$$

When both the volume average particle diameter and GSDp are in the above-mentioned range, extremely small particles are not existed in the toner. Therefore, deterioration in development property due to an excessive charging amount of the small toner particles may be prevented, and thus it is preferable.

As for a method of measuring a particle diameter of the toner particles or the binder resin particles according to an aspect of the invention, the following methods may be used.

According to an aspect of the invention, for a method of measuring a particle diameter of the toner in case where the particle diameter to be measured is 2 μm or higher, there can be suitably exemplified a method in which 10 mg of measurement sample is added to a surfactant which is a dispersant, preferably 2 ml of 5% sodium dodecylbenzene sulfonate solution, this mixture is added to 100 ml of an electrolyte, and then measurement is carried out by using Coulter Multisizer type II (manufactured by Beckman Coulter Inc.) as a measurement device and ISOTON-II (manufactured by Beckman Coulter Inc.) as the electrolyte.

For the method of measuring a particle diameter of the toner in case where the particle diameter to be measured is below 2 μm, there can be exemplified a method in which a sample in a state of dispersion liquid is adjusted to be approximately 2 g of solid content, ion-exchange water is added to the sample to give approximately 40 ml of solution, the solution is injected to a cell until the concentration in the cell becomes suitable, and after two minutes of waiting, when the concentration in the cell becomes almost stable, measurement is carried out by using a laser diffraction type particle size distribution measuring device (LA-700: manufactured by Horiba Inc.).

In addition, for measuring the volume average particle diameter, values of the volume average particle diameter for every channel thus obtained are accumulated from the volume average particle diameter of small value and the volume average particle diameter is set at an accumulation of 50%.

In case of measuring fine particles such as external additives, there can be exemplified a method in which 2 g of measurement sample is added to a surfactant, preferably 50 ml of 5% sodium alkylbenzene sulfonate solution, this mixture is dispersed for 2 minutes by using an ultrasonic dispersion device (1,000 Hz) to prepare a sample, and the sample is measured in the same manner as the above-mentioned dispersion liquid is measured.

SF1 which is a shape factor of the toner is preferably in the range of from 110 to 145, more preferably in the range of from 120 to 140. A carrier may be charged by contacting the toner. However, when the SF1 is in the range, it is possible to desirably maintain contact with the carrier and the toner. When SF1 is 110 or higher, an area of a contact point of the carrier and the toner is suitable. Particularly, an increase in charging amount of a toner which is newly added thereto is rapid and a toner having small charging amount is relatively decreased so that generation of fog can be prevented. In addition, when SF1 is 145 or below, a value of probability that the toner contacts the carrier at a point is suitable and excessive amount of pressure is not applied to a contact part of the toner and the carrier. As a result, it is possible to inhibit peeling of a coated resin on the carrier due to external additives contained in the toner, and thus the charging amount of the toner is excellent. In particular, the above-mentioned tendency is strongly shown in a color image which uses a large amount of the toner. It is particularly preferred that SF1 of the toner is in such the range.

A shape factor SF1 of the toner particles and the carrier particles described later is a shape factor denoting a degree of concavo-convex of a surface of the particles and calculated in accordance with the following formula.

$$SF1 = \frac{(ML)^2}{A} \times \frac{\pi}{4} \times 100 \quad \text{[Equation 1]}$$

In Equation 1, ML indicates the maximum length of the particles and A indicates an area where the particles are projected (projected area).

For a specific method of measuring SF1, there can be exemplified a method in which firstly an optical microscopic image of the toner or the carrier which are sprayed on a slide glass is transported into an image analyzing device through a video camera, values of SF1 of the fifty toners or carriers are calculated, and an average value is calculated.

The glass transition temperature of the binder resin employable in the invention is preferably in the range of from 50 to 70° C., more preferably in the range of from 50 to 65° C., further preferably in the range of from 50 to 60° C. When the temperature is in such the range, it is possible to easily control an inner structure of the toner or a shape of the toner, and thus it is preferable.

The glass transition temperature of the binder resin used in the toner of the invention is calculated on the basis of its maximum peak determined in accordance with a DSC (differential scanning calorimetry) measurement method and measured in accordance with ASTMD 3418-8.

For a method of measuring the maximum peak, there can be exemplified a method in which DSC-7 manufactured by PerkinElmer Inc. is used, the melting point of indium and zinc is used for temperature correction of a detection unit in the device, the melting heat of indium is used for correction of the amount of heat, and measurement of a sample is carried out by the use of an aluminum pan and an empty pan for the comparison under the condition of the temperature increase rate of 10° C./min.

(Polymerizable Aromatic Monomer Having an Ethylenically Unsaturated Double Bond Conjugated to Aromatic Ring Thereof)

Examples of a polymerizable aromatic monomer having an ethylenically unsaturated double bond conjugated to an aromatic ring thereof employable in the toner of the invention are not particularly limited, but there may be suitably used compounds which contain an aromatic ring which can be substituted partly or entirely with alkyl groups such as a methyl group or an ethyl group, a halogen atom such as a chlorine atom or a bromine atom, an alkoxy group such as a phenolic hydroxyl group, a carboxyl group, an acetyl group, a methoxy group, an ethoxy group, a nitro group, an amino group, an acetylamino group, an (di)alkylamino group, or the like; and a substituted or non-substituted vinyl group conjugated to the aromatic ring. Examples of the aromatic ring include a benzene ring, a naphthalene ring, an anthracene ring, a phenanthrene ring, and the like. In addition, the aromatic ring may be a heteroaromatic ring which a part of the aromatic ring thereof is constituted with, for example, a nitrogen atom.

Polymerizability of the polymerizable aromatic monomer having an ethylenically unsaturated double bond conjugated to an aromatic ring thereof is varied depending on electron density in the aromatic ring. In such a case, since a polymerization rate becomes rapid as electron density in the ethylenically unsaturated double bond increases, a functional group substituted with the aromatic ring is preferably an electron-donating group. However, since it is hard to control reactions when electron-donating property is too strong. Therefore, it is more preferred to use styrene or alkyl styrene.

(Nitrogen-Containing Polymerizable Aliphatic Monomer)

For a nitrogen-containing polymerizable aliphatic monomer, however there is no specific limitation, a monomer in which nitrogen is constituted in a side chain of the molecular thereof constituting the resin is preferred than constituting nitrogen in a main chain. The reason is that nitrogen can be easily existed on the surface of the toner when the polymerizable monomer having nitrogen in its side chain becomes the toner particle.

In addition, for the nitrogen-containing polymerizable aliphatic monomer, a compound containing a nitrogen atom in a carbon chain of an alkoxy part of (meth)acrylate esters is preferred. A compound containing a non-substituted, monosubstituted, or disubstituted amino group or a non-substituted, monosubstituted, or disubstituted nitro group in the carbon chain of the alkoxy part of (meth)acrylate esters is more preferred.

Specific examples of the nitrogen-containing polymerizable aliphatic monomer preferably include aminoalkyl (meth)acrylates such as aminomethyl(meth)acrylate, aminoethyl(meth)acrylate, and aminopropyl(meth)acrylate; alkyl aminoalkyl(meth)acrylates such as methyl aminomethyl (meth)acrylate, methyl aminoethyl(meth)acrylate, and methyl aminopropyl(meth)acrylate; dialkyl aminoalkyl (meth)acrylates such as dimethyl aminomethyl(meth)acrylate, dimethyl aminoethyl(meth)acrylate, and dimethyl aminopropyl(meth)acrylate; and nitroalkyl(meth)acrylates such as nitromethyl(meth)acrylate, nitroethyl(meth)acrylate, and nitropropyl(meth)acrylate.

(Sulfur-Containing Aliphatic Compound)

A sulfur-containing aliphatic compound is used to control a polymerization degree at the time of the polymerization as mentioned above and generally serves as a chain transferring agent.

For the sulfur-containing aliphatic compound, however there is no specific limitation as long as it is an aliphatic compound containing sulfur atoms, a compound containing a thiol component is suitably used. From a viewpoint of capability of controlling variations in electric charge due to the environment such as temperature and humidity, alkyl mercaptans are more preferred, alkyl mercaptans having 6 or more carbon atoms is further preferred, and alkyl mercaptans having 6 to 12 carbon atoms is particularly preferred. Specific examples of alkyl mercaptans preferably include hexyl mercaptan, heptyl mercaptan, octyl mercaptan, nonyl mercaptan, decyl mercaptan, dodecyl mercaptan.

(Other Polymerizable Monomers)

For the binder resin which can be used in the invention, polymerizable monomers other than the polymerizable aromatic monomers, the nitrogen-containing polymerizable aliphatic monomers, and the sulfur-containing aliphatic compounds may be used in combination, if necessary.

As for the other polymerizable monomers, the well known polymerizable monomers may be used, and preferably (meth) acrylate esters or unsaturated hydrocarbons may be used.

Specific examples of the other polymerizable monomers preferably include (meth)acrylate esters such as n-methyl (meth)acrylate, n-ethyl(meth)acrylate, n-propyl(meth)acrylate, n-butyl(meth)acrylate, n-pentyl(meth)acrylate, n-hexyl (meth)acrylate, n-heptyl(meth)acrylate, n-octyl(meth) acrylate, n-decyl(meth)acrylate, n-dodecyl(meth)acrylate, n-lauryl(meth)acrylate, n-tetradecyl(meth)acrylate, n-hexadecyl(meth)acrylate, n-octadecyl(meth)acrylate, isopropyl (meth)acrylate, isobutyl(meth)acrylate, t-butyl(meth)acrylate, isopentyl(meth)acrylate, amyl(meth)acrylate, neopentyl (meth)acrylate, isohexyl(meth)acrylate, isoheptyl(meth) acrylate, isooctyl(meth)acrylate, 2-ethylhexyl(meth) acrylate, phenyl(meth)acrylate, biphenyl(meth)acrylate, diphenylethyl(meth)acrylate, t-butylphenyl(meth)acrylate, terphenyl(meth)acrylate, cyclohexyl(meth)acrylate, t-butylcyclohexyl(meth)acrylate, methoxyethyl(meth)acrylate, 2-hydroxyethyl(meth)acrylate, β-carboxyethyl(meth)acrylate, or the like; and unsaturated hydrocarbons such as ethylene, propylene, or the like.

To the binder resin according to an aspect of the invention, a cross-linking agent may be added, if necessary. For the cross-linking agent, a multifunctional monomer having two or more ethylenically unsaturated groups in the molecular thereof is generally used.

Specific examples of the cross-linking agent include multivinyl aromatic compounds such as divinylbenzene, divinylnaphthalene, and the like; divinyl esters of aromatic polyvalent carboxylic acid such as divinyl phthalate, divinyl isophthalate, divinyl terephthalate, divinyl homophthalate, trimesic acid divinyl/trivinyl, divinyl naphthalenedicarboxylate, divinyl biphenylcarboxylate, and the like; divinyl esters of nitrogen-containing aromatic compounds such as divinyl pyridinedicarboxylate, and the like; vinyl esters of carboxylic acid which is an unsaturated heterocyclic compound such as piromucin acid vinyl, vinyl furancarboxylate, vinyl pyrrole-2-carboxylate, vinyl thiophenecarboxylate, and the like; (meth)acrylate esters of straight-chain polyvalent alcohol such as butanediol methacrylate, hexanediol acrylate, octanediol methacrylate, decanediol acrylate, dodecanediol methacrylate, etc; (meth)acrylate esters of branched and substituted polyvalent alcohol such as neopentyl glycol dimethacrylate, 2-hydroxy-1,3-diacryloxypropane, and the like; polyethylene glycol di(meth)acrylates and polypropylene polyethylene glycol di(meth)acrylates; polyvinylesters of polyvalent carboxylic acid such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedioic acid, divinyl brassylate, etc; and the like.

According to an aspect of the invention, the above-mentioned cross-linking agents can be used alone or in combination with two or more kinds thereof.

Among those cross-linking agents, it is preferred to use (meth)acrylate esters of straight-chain polyalcohol such as butanediol methacrylate, hexanediol acrylate, octanediol methacrylate, decanediol acrylate, dodecanediol methacrylate, etc; (meth)acrylate esters of branched and substituted polyalcohol such as neopentyl glycol dimethacrylate, 2-hydroxy-1,3-diacryloxypropane, and the like; polyethylene glycol di(meth)acrylates and polypropylene polyethylene glycol di(meth)acrylates; and the like as the cross-linking agent according to an aspect of the invention.

A preferred amount of the cross-linking agent to be contained is in the range of from 0.05 to 5% by weight, more preferably in the range of from 0.1 to 1.0% by weight relative to the total amount of the polymerizable monomers.

The binder resin used in the toner of the invention which can be prepared by radical polymerization of the polymerizable monomer may be polymerized by the use of radical polymerization initiators.

The radical polymerization initiators to be used herein are not particularly limited. However, it is preferred to use an initiator which allows decreasing a pH variation in reaction system at the time of the reaction. The reason is that the nitrogen-containing polymerizable aliphatic monomers are not always strong against acid, and thus the functional group of a nitrogen part is broken due to the pH variation and it is hard to obtain a resin having preferable charging amount.

Specific examples of the radical polymerization initiators include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropylperoxycarbonate, teralinhydroperoxide, 1-phenyl-2-methylpropyl-1-hydroperoxide, tert-butyl hydroperoxide pertriphenylacetate, tert-butyl performate, tert-butyl peracetate, tert-butyl perbenzoate, tert-butyl perphenylacetate, tert-butyl permethoxyacetate, tert-butyl per-N-(3-toluyl)carbamate, and the like; azo compounds such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis(2-amidinopropane) nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(1-methylbutyronitrile-3-sodium sulfate), 2-(4-methyphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A-4,4'-azobis-4-cyanopentanoate), poly(tetraethylene glycol-2,2'-azobisisobutylate), and the like; and 1,4-bis(pentaethylene)-2-tetrazene, 1,4-dimethoxycarbonyl-1,4-diphenyl-2-tetrazene, and the like <Surfactant>

In production of the toner of the invention, a surfactant may be used, for example, for the purpose of stabilizing dispersion during the suspension polymerization method and for stabilization of dispersion of a resin particle dispersion liquid, a colorant dispersion liquid, and a release agent dispersion liquid during the emulsion polymerization aggregation method.

Examples of surfactants include anionic surfactants such as sulfate ester salts, sulfonate salts, phosphate esters, and soaps; cationic surfactants such as amine salts and quaternary ammonium salts; nonionic surfactants such as polyethylene glycols, alkylphenol ethylene oxide adducts, and polyvalent alcohols; and the like. Among them, ionic surfactants are preferable, and anionic and cationic surfactants are more preferable.

For the toner of the invention, anionic surfactants generally have a higher dispersion force and are superior in dispersing resin particles and colorants. Accordingly, it is preferred to use an anionic surfactant as the surfactant for dispersing release agents.

It is preferred to use the nonionic surfactant in combination with the anionic or the cationic surfactant. These surfactants may be used alone, or in combinations of two or more kinds thereof.

Specific examples of anionic surfactants include fatty acid soaps such as potassium laurate, sodium oleate, sodium castor oil, and the like; sulfate esters such as octyl sulfate, lauryl sulfate, lauryl ether sulfate, nonylphenylether sulfate, and the like; sodium alkylnaphthalenesulfonic acid such as lauryl sulfonate, dodecylbenzene sulfonate, triisopropylnaphthalene sulfonate, dibutylnaphthalenesulfonate, and the like; sulfonate salts such as naphthalenesulfonate formaline condensates, monooctylsulfosuccinate, dioctylsulfosuccinate, lauric amide sulfonate, oleic amide sulfonate, and the like; phosphoric acid esters such as lauryl phosphate, isopropyl phosphate, nonylphenylether phosphate, and the like; dialkylsulfosuccinate salts such as sodium dioctylsulfosuccinate; sulfosuccinate salts such as disodium laurylsulfosuccinate; and the like.

Specific examples of cationic surfactants include amine salts such as laurylamine hydrochloride, stearylamine hydrochloride, oleylamine acetate salt, stearylamine acetate salt, and stearylaminopropylamine acetate salt; quaternary ammonium salts such as lauryltrimethylammonium chloride, dilauryldimethylammonium chloride, distearyldimethylammonium chloride, lauryldihydroxyethylmethylammonium chloride, oleyl-bispolyoxyethylene-methylammonium chloride, lauroylaminopropyldimethylhydroxyethylammonium ethosulfate, lauroylaminopropyldimethylhydroxyethylammonium perchlorate, alkylbenzenetrimethylammonium chlorides, alkyltrimethylammonium chlorides, and the like; and the like.

Specific examples of nonionic surfactants include alkyl ethers such as polyoxyethylene octylether, polyoxyethylene laurylether, polyoxyethylene stearylether, polyoxyethylene oleylether, and the like; alkylphenylethers such as polyoxyethylene octylphenylether, polyoxyethylene nonylphenylether, and the like; alkyl esters such as polyoxyethylene laurate, polyoxyethylene stearate, polyoxyethylene oleate, and the like; alkylamines such as polyoxyethylene laurylaminoether, polyoxyethylene stearylaminoether, polyoxyethylene oleylaminoether, polyoxyethylene soy bean aminoether, polyoxyethylene beef tallow aminoether, and the like; alkylamides such as polyoxyethylene lauric amide, polyoxyethylene stearic amide, polyoxyethylene oleic amide, and the like; vegetable oil ethers such as polyoxyethylene castor oil ether, polyoxyethylene rapeseed oil ether, and the like; alkanol amides such as lauric diethanolamide, stearic diethanolamide, oleic diethanolamide, and the like; sorbitan ester ethers such as polyoxyethylene sorbitan monolaurate, polyoxyethylene sorbitan monopalmeate, polyoxyethylene sorbitan monostearate, polyoxyethylene sorbitan monooleate, and the like; and the like.

The content of the surfactants in the dispersion liquids is not particularly limited as long as the surfactants therein do not impair the effects of the invention, but generally is small amount. Specifically, the content is in the range of from 0.01 to 3% by weight, more preferably in the range of from 0.05 to 2% by weight, and further preferably in the range of from 0.1 to 1% by weight. When the content of the surfactant is in such the range, the dispersion liquids of the resin particle, colorant, and release agent becomes stable, aggregation or separation of particular particles does not occur, an amount of copper compounds to be added is not affected, thereby obtaining sufficient effects of the invention. In general, suspension-polymerized toner dispersions having large diameter remain stable even when a small amount of surfactant is used.

<Charge Control Agent>

In the toner of the invention, a charge control agent may be added, if necessary.

As for the charge control agent, the well known charge control agents can be used. However, a charge control agent of resin type which includes halides of alkyl(phenyl) compound having quaternary ammonium group and a polar group can be used. In case of producing the toner by a wet type production method, it is preferred to use water-insoluble materials from a viewpoint of control of ion strength and decrease in contamination of waste water. In addition, the toner of the invention may be any of a magnetic toner containing magnetic materials and non-magnetic toner not containing magnetic materials.

<Aggregating Agent>

When an emulsion polymerization aggregation method is used for the production of the toner of the invention, in the aggregation process, aggregation may occur due to a pH variation and thus a particle of a toner particle diameter which contains a binder resin and a colorant is produced. At the same time, an aggregating agent may be added in order to make the aggregation of particles more reliable and faster, or to obtain aggregated particles which are narrow in particle size distribution.

A compound having a monovalent or higher-valent electric charge is preferable as the aggregating agent. Specific examples of such compounds include water-soluble surfactants such as the ionic and nonionic surfactants described above; acids such as hydrochloric acid, sulfuric acid, nitric acid, acetic acid, and oxalic acid; inorganic acid metal salts such as magnesium chloride, sodium chloride, aluminum sulfate, calcium sulfate, ammonium sulfate, aluminum nitrate, silver nitrate, copper sulfate, and sodium carbonate; aliphatic or aromatic acid metal salts such as sodium acetate, potassium formate, sodium oxalate, sodium phthalate, and potassium salicylate; phenolic metal salts such as sodium phenolate; and the like.

Taking into account of stability of aggregated particles, stability of the aggregating agent in response to heat and the passage of time, and removing the aggregating agent at the time of washing, inorganic acid metal salts are preferable as the aggregating agent in regard of their properties and usability. Specific examples of aggregating agents include inorganic acid metal salts such as magnesium chloride, sodium chloride, aluminum sulfate, calcium sulfate, ammonium sulfate, aluminum nitrate, silver nitrate, copper sulfate, and sodium carbonate.

An amount of these aggregating agents to be added may be varied according to a valency of electric charge thereof, but is small amount in any case. The amount is 3% by weight or less in case of a monovalent, 1% by weight or less in case of a bivalent, and 0.5% by weight or less in case of a trivalent. Since it is preferred to use aggregating agents in small amounts, it is preferred to use a compound with a high-valency electric charge.

<Colorant for Toner>

There is no particular limitation on a colorant for toner, the general dyes and pigments can be used. However, it is preferred to use pigments to carry out a process of producing a toner in water as the invention because there are water-soluble dyes.

More specifically, examples of yellow-based colorants include monoazo pigments such as C. I. Pigment Yellow 74 and C. I. Pigment Yellow 1, 2, 3, 5, 6, 49, 65, 73, 75, 97, 98, 111, 116, and 130; benzimidazolone pigments such as C. I. Pigment Yellow 154 and C. I. Pigment Yellow 120, 151, 175, 180, 181, and 194; disazo condensation pigments such as C. I. Pigment Yellow 93 and C. I. Pigment Yellow 94, 95, 128, and 166; isoindolinone pigments such as C. I. Pigment Yellow 110 and C. I. Pigment Yellow 109; anthracene-quinone pigments such as C. I. Pigment Yellow 147 and C. I. Pigment Yellow 24, 108, 193, and 199; disazo pigments such as C. I. Pigment Yellow 12, 13, 14, 17, 55, 63, 81, 83, 87, 90, 106, 113, 114, 121, 124, 126, 127, 136, 152, 170, 171, 172, 174, 176, and 188; azorake pigments such as C. I. Pigment Yellow 61, 62, 133, 168, and 169; and isoindoline pigments such as C. I. Pigment Yellow 139; quinophthalone pigments such as C. I. Pigment Yellow 138.

In addition, examples of magenta-based colorants include β-naphthol pigments such as C. I. Pigment Red 146 and C. I. Pigment Red 2, 5, 7, 8, 9, 10, 11, 12, 13, 14, 15, 16, 17, 18, 21, 22, 23, 31, 32, 95, 112, 114, 119, 136, 147, 148, 150, 164, 170, 184, 187, 188, 210, 212, 213, 222, 223, 238, 245, 253, 256, 258, 261, 266, 267, 268, and 269; azorake pigments such as C. I. Pigment Red 57:1 and C. I. Pigment Red 18:1, 48:2, 48:3, 48:4, 48:5, 50:1, 51, 52:1, 52:2, 53:1, 53:2, 53:3, 58:2, 58:4, 64:1, 68, and 200; quinacridone pigments such as C. I. Pigment Red 209, C. I. Pigment Red 122, 192, 202, and 207, and C. I. Pigment Violet 19; disazo pigments such as C. I. Pigment Red 37, 38, 41, and 111, and C. I. Pigment Orange 13, 15, 16, 34, and 44; benzimidazolone pigments such as C. I. Pigment Red 171, 175, 176, 185, and 208, C. I. Pigment Violet 32, and C. I. Pigment Orange 36, 60, 62, and 72; disazo condensation pigments such as C. I. Pigment Red 144, 166, 214, 220, 221, 242, 248, and 262, and C. I. Pigment Orange 31; dioxadine pigments such as C. I. Pigment Violet 23 and 37; and diketopyrrolo pyrrole pigments such as C. I. Pigment Red 254, 255, 264, and 272, and C. I. Pigment Orange 71 and 73.

Examples of blue pigments include organic colorants such as iron blue, cobalt blue, alkali blue lake, Victoria blue lake, Fast Sky Blue, Indanthren blue BC, ultramarine blue, phthalocyanine blue, phthalocyanine green, and the like.

Examples of black pigments include organic colorants such as carbon black, aniline black, and the like.

Examples of green pigments include chromium green, Pigment Green B, malachite green lake, and Final Yellow Green G. Examples of purple pigments include manganese purple, Fast Violet B, and methyl violet lake. In addition, examples of the dyes include various dyes such as basic, acidic, dispersion, and direct dyes, for example, nigrosin, methylene blue, rose bengal, quinoline yellow, and the like.

<Method of Dispersing Colorants>

In a method of dispersing the colorants, the colorants and dispersants such as the surfactants are dispersed in a water-based medium due to a mechanical impact, thereby preparing a colorant dispersion liquid. The colorants are aggregated with the binder resins, and then granulated to have a toner particle diameter, thereby achieving dispersion of the colorants.

Specific example of dispersion of the colorants due to a mechanical impact is that a dispersion liquid of the colorant particle is prepared by the use of a medium dispersing machine such as a rotary shearing homogenizer, a ball mill, a sand mill, or an attritor; and a high-pressure counter collision dispersing machine. In addition, by using a polar surfactant, it is possible to disperse these colorants in the water-based medium by means of a homogenizer.

In order to ensure coloring property of the colorant at the time of fixation, the amount of the colorant to be added is preferably in the range of from 4 to 15% by weight, more preferably in the range of 4 from to 10% by weight, relative to the total amount of the solid content of the toner. However, when a magnetic material is used as a black colorant, the amount of the colorant to be added is preferably in the range of 12 to 48% by weight, more preferably in the range of 15 to 40% by weight. When the types of the colorants are suitably selected to use, various colored toners are obtained such as a yellow toner, a magenta toner, a cyan toner, a black toner, a white toner, a green toner, and the like.

<Release Agent>

To the toner of the invention, a release agent can be added, if necessary. In general, a release agent is used for improving releasibility. However, it is preferred to use the release agent having a polar group in order to inhibit the excessive electric charge particularly under winter conditions. Since the polar group interacts with water molecules, generation of the electric charge under winter conditions can be inhibited. Specific examples of the release agents include low-molecular weight polyolefins such as polyethylene, polypropylene, and polybutene; silicones having a softening point by heating; fatty acid amides such as oleic amide, erucic amide, recinoleic amide, and stearic amide; vegetable waxes such as carnauba wax, rice wax, candelilla wax, Japan tallow, and jojoba oil; animal waxes such as bee wax; mineral and petroleum waxes such as montan wax, ozokerite, ceresin, paraffin wax, microcrystalline wax, and Fischer-Tropsch wax; ester waxes such as fatty acid ester, montaic acid ester, and carboxylic acid ester; and the like. Among these, vegetable waxes such as carnauba wax, rice wax, candelilla wax, Japan tallow, and jojoba oil; animal waxes such as bee wax; and ester waxes such as fatty acid ester, montaic acid ester, and carboxylic acid ester are preferred for the above-mentioned purposes.

In the invention, these release agents may be used alone or in combinations of two or more kinds thereof.

The amount of the release agents to be added is preferably in the range of from 1 to 20% by weight, more preferably in the range of from 5 to 15% by weight, relative to the total amount of the toner particles (the total amount of the solid content of the toner). When the amount of the release agents to be added is in the range, sufficient effect of the release agent can be obtained, the toner particles is hardly destroyed inside of a developing machine, the carrier is not stained with the release agents, thereby hardly decreasing the electric charge.

<Internal Additives>

For the toner of the invention, internal additives may be added to inside of the toner. The internal additives are generally used for controlling viscoelasticity of a fixed image. Specific examples of the internal additives include inorganic particles such as silica, titania, etc; or organic particles such as polymethacrylate, and the like. The surface of these internal additives may be treated for the purpose of increasing dispersion property. In addition, the internal additives can be used alone or in combination with two or more kinds thereof.

<External Additives>

In the toner of the invention, external additives such as a fluidizing agent or a charge control agent may be added. As for the external additives, the well known materials, for example, inorganic particles such as a silica particle, a titanium oxide particle, an alumina particle, a cerium oxide particle, and carbon black of which surfaces are treated with silane coupling agents; polymer particles such as polycarbonate, polymethyl methacrylate, a silicone resin, and the like; amine metal salt; salicylic acid metal complex; and the like may be used. These external additives can be used alone or in combination with two or more kinds thereof.

<Method of Producing Toner>

Preferred method of producing a toner for developing an electrostatic charge image used in the invention is an emulsion polymerization aggregation method. As mentioned above, according to the process, it is possible to control a specific functional group to be in a specific moiety. Therefore, it is easy to achieve an effect of the invention.

According to the emulsion polymerization aggregation method, it is possible to allow a specific nitrogen-containing functional group to be existed on the surface of the toner during a process of mixing a resin particle dispersion liquid in which a resin particle having a particle diameter of 1 μm or below is dispersed and a colorant dispersion liquid in which a colorant is dispersed and aggregating the resin particle and the colorant to have a toner particle diameter (hereinafter, may be referred as a 'aggregation process'), thereby solving the above-mentioned problems.

The emulsion polymerization aggregation method includes a process of heating the aggregated particles which has been subjected to the aggregation process at the temperature higher than the glass transition point of the resin particle and fusing the aggregates to form toner particles (hereinafter, referred as a 'fusion process').

In the aggregation process, particles in a mixture of the resin particle dispersion liquid, the colorant dispersion liquid, and optionally the release agent dispersion liquid are aggregated to form the aggregated particles having the toner particle diameter. The aggregated particles are formed by a process such as heteroaggreation, and for the purposes of stabilizing the aggregated particles and controlling the particle size/particle size distribution, an ionic surfactant or a compound having a monovalent or higher-valent electric charge such as a metal salt may be added to the aggregated particles.

Here, the 'toner particle diameter' indicates a volume average particle diameter of the toner described below.

In the fusion process, the resin particles in the aggregated particles are melted under the temperature condition of the glass transition point of the resin particle or higher, and a shape of the aggregated particle is varied from an irregular shape to further a ring shape. At this time, a component derived from the nitrogen-containing polymerizable aliphatic monomer disposed in the neighborhood of the surface of aggregated particles is easily appeared in the neighborhood of the particles as the fusion progresses. One of the reasons is that nitrogen itself is hydrophilic, but more bigger reason is that the polymerizable monomer remained in the latter period of the reaction has high polarity but low reactivity, a polar group stable in dispersion is existed in the exterior of the particles, surface area of the interior of the aggregated particles is reduced as the fusion progresses, and therefore the hydrophilic group is further extruded to the surface of the particle. After that, the aggregates are separated from the water-based medium, and optionally washed and dried to form a toner particle.

<Carrier>

The toner of the invention is generally used for a monocomponent developer holding an electric charge giving structure in a developing device and also used for a bicomponent developer containing the toner and the carrier. For the carrier, a carrier having ferrite, iron powders, or the like as a core material coated with the resin is preferred. There is no particular limitation on the core materials (core materials for the carrier) to be used but magnetic metals such as iron, steel, nickel, cobalt, and the like; magnetic oxides such as ferrite, magnetite, and the like; or a glass bead may be exemplified. However, it is preferred to use a magnetic carrier from a viewpoint of using a magnetic brush method. The average particle diameter of the carrier core materials is preferred to be in the range of 3 to 10 times larger than the average particle diameter of the toner.

The shape factor SF1 of the carrier is preferably in the range of from 110 to 145, more preferably in the range of from 120 to 140. When the shape factor is in the range, the contact between the carrier and the toner is in a suitable state and thus the effect of charging amount is further improved.

As for coating resins, it is preferred to use acrylic resins, styrene resins, hydrocarbon resins, or resins copolymerized with thereof. As for coating resins of the carriers, these may be used alone or in combination with two or more kinds thereof. In particular, for the purpose of giving a positive charging characteristic to the toner, it is preferred to use the acrylic resins, the styrene resins, the hydrocarbon resins, or the resins copolymerized with thereof in which at least one of hydrogen atoms thereof is substituted with a fluorine atom. The resin substituted with a fluorine atom is more preferred to use than the resin obtained by polymerizing a polymerizable composition containing at least one polymerizable monomer having a fluorine atom, further preferred than the resin obtained by using at least a (meth)acrylate compound having a fluorine atom. The reason is that the fluorine atom has a strong negative charging characteristic so that the toner can obtain a preferable positive charging characteristic.

Specific examples of the polymerizable monomers having the fluorine atom include fluoromethyl(meth)acrylate, difluoromethyl(meth)acrylate, trifluoromethyl(meth)acrylate, trifluoromethylethyl(meth)acrylate, tetrafluoroethylmethyl (meth)acrylate, perfluoropropylethyl(meth)acrylate, perfluorobutylethyl(meth)acrylate, perfluorohexylethyl (meth)acrylate, perfluorooctylethyl(meth)acrylate, perfluorooctylmethyl(meth)acrylate, and the like.

For the purpose of inhibiting the electric charge, the resin particles or the inorganic particles may be dispesed in the coating resins to be used.

Examples of a method of forming a resin coated layer on the surface of the carrier core material include a immersion method in which powders of the carrier core material are immersed in a solution for forming a coated layer; a spray method in which a solution for forming a coated layer is sprayed on the surface of the carrier core material; a fluid bed method in which a solution for forming a coated layer is sprayed on the carrier core material in the state of being floated by an air flow; a kneader coater method in which the carrier core material and a solution for forming a coated layer are mixed in a kneader-coater and the solvent is removed; and a powder coating method in which the coating resin is pulverized, mixed with the carrier core material in a kneader coater at the temperature of the melting point of the coating resin or higher, and cooled to be used for coating. However, the kneader coater method and the powder coating method are particularly preferably used.

According to the amount of the resin coating thus formed, the amount of resin in the range of from 0.5 to 10% by weight relative to the amount of the carrier core material is used for coating. The mixing ratio (weight ratio) of the toner and the carrier, toner:carrier, is preferably in the range of 1:100 to 30:100, more preferably in the range of 3:100 to 20:100.

<Image Forming Method>

An image forming method of the invention includes a latent image forming process of forming an electrostatic latent image on a surface of a latent image carrier (photoreceptor); a developing process of developing the electrostatic latent image formed on the surface of the latent image carrier by the use of a developer containing a toner to form a toner image; a transferring process of transferring the toner image formed on the surface of the latent image carrier to a surface of a transfer member; and a fixing process of heating and fixing the toner image transferred to the surface of the transfer member.

Each process is a normal process and is described in, for example, JP-A Nos. 56-40868 and 49-91231.

In addition, the image forming method of the invention may be carried out by the use of an image forming apparatus such as the well known copying machine, a facsimile, and the like.

The image forming method of the invention may include processes other than the above-mentioned processes and, for example, preferably include a cleaning process of removing the electrostatic charge image developer remained on the latent image carrier. According to the image forming method of the invention, an aspect in which a recycling process is included is preferred. The recycling process is a process of moving the toner for developing the electrostatic charge image recovered from the cleaning process to the developer layer. An aspect of the image forming method in which the recycling process is included may be carried out by the use of an image forming apparatus of toner recycling system type such as a copying machine, a facsimile, and the like. In addition, an aspect of recycling system in which the cleaning process is omitted and the toner is recovered at the time of developing may be applied to the image forming method.

As for the latent image carrier, for example, an electrophotographic photoreceptor and a dielectric recording medium may be used.

A charging method is not particularly limited, and any of a non-contact charging method by the use of the well known corotron or scorotron and a contact charging method may be used. However, the contact charging method which generates less ozone is preferred to use.

In the latent image forming process, a latent image carrying body of which surface is uniformly charged is exposed by an exposing unit such as a laser optical system or an LED array to form an electrostatic latent image. The method of exposing is not particularly limited.

In the developing process, the electrostatic latent image contacts or approaches a developing roll which a developer layer is formed on the surface thereof and the toner particles are attached to the electrostatic latent image, thereby forming a toner image on a photoreceptor of an electrophotography.

In the transferring process, the toner image is transferred on a transfer member. As for the transfer member, a transfer paper, an intermediate drum used for forming a color image, or an intermediate transfer belt may be used.

In the fixing process, the toner image transferred to the transfer paper or the like is fixed on a fixing substrate such as a paper by heating from a fixing member. While the fixing substrate such as a paper is passed through between the two fixing members, the toner image on the fixing substrate is heated and melted to be fixed on the substrate. The fixing members have a roll shape or a belt shape and a heating device is attached to at least one side thereof. As for the fixing members, the roll or the belt itself may be used or it may be used after coating a resin on the surface thereof.

The fixing roll is made by coating a silicone rubber, a viton rubber, etc on the surface of a core material of the roll.

As for the fixing belt, polyamide, polyimide, polyethylene therephthalate, polybutylene therephthalate, or the like is used alone or in combination with two or more kinds thereof. In addition, examples of resins coating the rolls and the belts include styrenes such as styrene, parachlorostyrene, and α-methylstyrene; α-methylene fatty monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acrylics such as dimethylaminoethyl methacrylate; vinyl nitriles such as acrylonitrile and methacrylonitrile; vinyl pyridines such as 2-vinylpyridine and 4-vinylpyridine; vinylethers such as vinylmethylether and vinylisobutylether; vinylketones such as vinylmethylketone, vinylethylketone, and vinylisopropenylketone; olefins such as ethylene and propylene; a homopolymer or a copolymer of two or more monomers of vinyl fluorine-containing monomers such as vinylidene fluoride, tetrafluoroethylene, and hexafluoroethylene; silicones such as methylsilicone, methylphenylsilicone, and the like; polyesters such as bisphenol, glycol, and the like; epoxy resins, polyurethane resins, polyamide resins, cellulose resins, polyether resins, polycarbonate resins, and the like. These resins may be used alone or in combination with two or more kinds thereof. Specific examples of the resins include a homopolymer of fluorine-containing compounds such as polytetrafluoroethylene, vinylidene fluoride, ethylene fluoride, etc and/or a copolymer thereof; and a homopolymer of unsaturated hydrocarbons such as ethylene, propylene, and the like and/or a copolymer thereof.

As for the transfer member on which the toner is fixed, a paper, a resin film, or the like is used. As for the paper for fixing, a coated paper which a part or a whole part of the paper surface is coated with resin may be used. As for the resin film for fixing, a resin coated film which a part or a whole part of the film surface is coated with the other kinds of resin may be used. Resin fine particles or inorganic particles may be added to the transfer member for the purpose of preventing the transfer member from being transferred in pile due to friction with papers or resin films and/or static electricity caused by the friction and preventing deterioration in fixability of the fixed image due to the release agent elected out to the interface between the transfer member and the fixed image at the time of fixing.

Specific examples of the resins coating the papers or the resin films include styrenes such as styrene, parachlorostyrene, and α-methylstyrene; α-methylene fatty monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate, and 2-ethylhexyl methacrylate; nitrogen-containing acrylics such as dimethylaminoethyl methacrylate; vinyl nitriles such as acrylonitrile and methacrylonitrile; vinyl pyridines such as 2-vinylpyridine and 4-vinylpyridine; vinylethers such as vinylmethylether and vinylisobutylether; vinylketones such as vinylmethylketone, vinylethylketone, and vinylisopropenylketone; olefins such as ethylene and propylene; a homopolymer or a copolymer of two or more monomers of vinyl fluorine-containing monomers such as vinylidene fluoride, tetrafluoroethylene, and hexafluoroethylene; silicone resins such as methylsilicone, methylphenylsilicone, and the like; polyesters such as bisphenol, glycol, and the like; epoxy resins, polyurethane resins, polyamide resins, cellulose resins, polyether resins, polycarbonate resins, and the like. These resins may be used alone or in combination with two or more kinds thereof.

Specific examples of inorganic particles include all the particles generally used as the external additives to the surface of the toner such as silica, titania, calcium carbonate, magnesium carbonate, tricalcium phosphate, cerium oxide, and the like. Examples of the resin particles include all the particles generally used as the external additives to the surface of the toner such as vinyl resins, polyester resins, silicone resins, and the like. In addition, these inorganic particles and the resin particles may be used for a fluidity-improving aid or the like.

<Image Forming Apparatus>

The image forming apparatus of the invention includes a latent image carrier; a charging unit that charges the latent image carrier; an exposing unit that exposes the charged latent image carrier to form an electrostatic latent image on the latent image carrier; a developing unit that develops the electrostatic latent image by the use of a developer to form a toner image; a transferring unit that transfers the toner image from the latent image carrier to a recording medium; and optionally, a fixing unit that fixes the toner image on a fixing substrate. In the transferring unit, two or more times of transferring process may be carried out by the use of an intermediate transfer member.

The electrostatic latent image carrier and the above-mentioned units are preferably used for the configurations of processes in the image forming method.

The units may employ the well known units for the image forming apparatus. The image forming apparatus used in the invention may include units or devices other than the above-mentioned configurations. In addition, the image forming apparatus used in the invention may carry out a plurality of the units at the same time.

Examples

Hereinafter, the invention will be described in detail with reference to Examples but the invention is not limited thereto.

In addition, in the description below, 'parts' indicates 'parts by weight' unless otherwise noted.

(Method of Measuring Particle Size and Particle Size Distribution)

Measurement of the particle diameter (may be referred as 'particle size') and the particle diameter distribution (may be referred as 'particle size distribution') according to an aspect of the invention will be described.

According to an aspect of the invention, in case where the particle diameter to be measured is 2 μm or higher, Coulter Multisizer type II (manufactured by Beckman Coulter Inc.) is used as a measurement device and ISOTON-II (manufactured by Beckman Coulter Inc.) is used as the electrolyte.

For the measurement method, 10 mg of a measurement sample is added to 2 ml of 5% sodium dodecylbenzene sulfonate solution which is a dispersant and this mixture is added to 100 ml of the electrolyte.

The electrolyte in which the sample is suspended is dispersed for 1 minute by the use of an ultrasonic dispersion device. A particle size distribution of the particles having a diameter in the range of from 2 to 60 μm is measured by Coulter Multisizer type II using an aperture having an aperture diameter of 100 μm and then a volume average distribution and a number average distribution thereof are calculated. The number of particles to be measured is 50,000.

A particle size distribution of the toner according to an aspect of the invention is obtained as follows. The measured particle size distribution is drawn into a volume accumulation distribution relative to a divided particle size range (channel) from a small particle size side, and the accumulation number particle diameters at an accumulation of 16% are designated as $D_{16p}$, and the accumulation volume particle diameters at an accumulation of 50% are designated as D50 v. In addition, the accumulation number particle diameters at an accumulation of 84% are designated as $D_{84p}$.

The volume average particle diameter GSDp according to an aspect of the invention is calculated by $D_{50v}$, in accordance with the following formula.

$$GSDp=\{(D_{84p})/(D_{16p})\}^{0.5}$$

According to an aspect of the invention, in case where the particle diameter to be measured is below 2 μm, measurement is carried out by using a laser diffraction type particle size distribution measuring device (LA-700: manufactured by Horiba Inc.). For the measurement method, a sample in a state of dispersion liquid is adjusted to be approximately 2 g of solid content, ion-exchange water is added to the sample to have approximately 40 ml of solution, the solution is added to a cell until the concentration in the cell becomes suitable, and after two minutes of waiting, when the concentration in the cell becomes almost stable. Values of the volume average particle diameter for every channel thus obtained are accumulated from small values of the volume average particle diameter and the volume average particle diameter is set at an accumulation of 50%.

In case of measuring powder such as external additives, 2 g of measurement sample is added to a surfactant, preferably 50 ml of 5% sodium alkylbenzene sulfonate solution, this mixture is dispersed for 2 min by using an ultrasonic dispersion device (1,000 Hz) to prepare a sample, and the sample is measured in the same manner as the above-mentioned dispersion liquid is measured.

(Method of Measuring Shape Factor SF1 of Toners and Carriers)

The shape factor SF1 of the particles is the shape factor which represents a degree of concavo-convex of the surface of the particles and calculated in accordance with the following formula.

$$SF1 = \frac{(ML)^2}{A} \times \frac{\pi}{4} \times 100 \quad \text{[Equation 2]}$$

Wherein ML indicates the maximum length of the particles and A indicates an area where the particles are projected (projected area).

For the measurement, firstly an optical microscopic image of the toner or the carrier which are sprayed on a slide glass is transported into an image analyzing device through a video camera, values of SF1 of the fifty toners or carriers are calculated, and an average value is calculated.

(Method of Measuring Molecular Weight and Molecular Weight Distribution of Toners and Binder Resins)

The measurement of the specific molecular weight distribution and the molecular weight of the toner for developing the electrostatic charge image according to an aspect of the invention is carried out under the following conditions.

'HLC-8120GPC, SC-8020 device (manufactured by Tosoh Corp.)' is used as the GPC, two columns of 'TSK gel and Super HM-H (manufactured by Tosoh Corp. 6.0 mmID×15 cm)' are used, and THF (tetrahydrofuran) is used as the eluant. The measurement conditions are as follows: sample concentration: 0.5%; flow rate: 0.6 ml/min.; sample injection: 10 μl; measurement temperature: 40° C.; and an IR detector. A calibration curve is drawn by using ten 'polystylene standard samples, TSK Standards' manufactured by Tosoh Corp: 'A-500', 'F-1', 'F-10', 'F-80', 'F-380', 'A-2500', 'F-4', 'F-40', 'F-128', and 'F-700'.

(Method of Measuring Glass Transition Temperature of Toner and Binder Resin)

The glass transition temperature of the toner and the binder resin used in the toner of the invention is calculated on the basis of its maximum peak determined according to a DSC (differential scanning calorimetry) measurement method and measured in accordance with ASTMD 3418-8.

For measuring the maximum peak, DSC-7 manufactured by PerkinElmer Inc. is used, the melting point of indium and zinc is used for temperature correction of a detection unit in the device, the melting heat of indium is used for correction of the amount of heat, and measurement of a sample is carried out by the use of an aluminum pan and an empty pan as a comparison under the condition of the temperature increase rate of 10° C./min.

(Fluorescence X-Ray Measurement Method)

The measurement of MN, MS, and MN/MS according to the Examples is carried out in accordance with a fluorescence X-ray measurement method.

For a pre-treatment of the sample, 6 g of the toner is subjected to a pressure molding under conditions of 10 t of pressure for 1 minute in a pressure molding machine.

The measurement is carried out by the use of a fluorescence X-ray (XRF-1500) manufactured by Shimadzu Corporation under measurement conditions of 40 KV of tube voltage and 90 mA of tube current for 30 minutes of measurement time.

<Preparation of Binder Resin Particle Dispersion Liquid (1)>

| | |
|---|---|
| Styrene | 79 parts |
| n-butyl acrylate | 5.2 parts |
| Dimethyl aminoethyl acrylate | 15.8 parts |
| Acrylic acid | 1.8 parts |
| Dodecanethiol | 1 parts |

-continued

| | |
|---|---|
| Divinyl adipate (hereinbefore, manufactured by WakoPure Chemical Industries Co., Ltd.) | 0.6 parts |

A mixture in which above components are mixed and dissolved is added to a solution in which 1.5 parts of a nonionic surfactant (Nonipole 400: manufactured by Sanyo Chemical Industries Co., Ltd.), 2 parts of an anionic surfactant (Neogen SC: manufactured by Dai-ichi Kogyo Seiyaku Co., Ltd.), and 150 parts of ion-exchange water are dissolved. Then, the mixture is dispersed and emulsified in a flask, and slowly mixed for 10 min. 28.2 parts of ion-exchange water in which 5 parts of sodium persulfate (manufactured by WakoPure Chemical Industries Co., Ltd.) is dissolved is introduced to the flask and the flask is substituted with nitrogen for 20 min at the rate of 0.1 liter/min. After that, the mixture in the flask is stirred and heated in an oil bath until the temperature of the contents reached up to 70° C. The emulsion polymerization is continued for 5 hours to prepare a binder resin particle dispersion liquid (1) having an average particle diameter of 210 nm and a solid content concentration of 40%. A part of the dispersion liquid is left in an oven of 100° C. to dehydrate and subjected to a DSC (differential scanning calorimetry) measurement. As a result, the glass transition temperature of the dispersion liquid is 53° C. and weight average molecular weight is 36,000. At this time, MN/MS of the resin is 7.5.

<Preparation of Binder Resin Particle Dispersion Liquid (2)>

| | |
|---|---|
| Styrene | 80 parts |
| n-butyl acrylate | 16.8 parts |
| Dimethyl aminoethyl acrylate | 3.2 parts |
| Acrylic acid | 1.8 parts |
| Dodecanethiol | 1.5 parts |
| Divinyl adipate | 0.6 parts |

A binder resin particle dispersion liquid (2) is prepared in the same manner as in the preparation of the binder resin particle dispersion liquid (1) except that the components are changed with the above components and an amount of sodium persulfate to be used is changed to 3 parts. The average particle diameter of the dispersion liquid is 200 nm, the solid content concentration is 40%, the glass transition temperature is 53° C., and the weight average molecular weight is 33,000. At this time, MN/MS of the resin is 1.2.

<Preparation of Binder Resin Particle Dispersion Liquid (3)>

| | |
|---|---|
| Styrene | 78 parts |
| n-butyl acrylate | 13.8 parts |
| Dimethyl aminoethyl acrylate | 8.2 parts |
| Acrylic acid | 1.8 parts |
| Dodecanethiol | 2.0 parts |
| Divinyl adipate | 0.6 parts |

A binder resin particle dispersion liquid (3) is prepared in the same manner as in the preparation of the binder resin particle dispersion liquid (1) except that the components are changed with the above components and an amount of sodium persulfate to be used is changed to 1.5 parts. The average particle diameter of the dispersion liquid is 220 nm, the solid content concentration is 40%, the glass transition temperature is 53° C., and the weight average molecular weight is 32,000. At this time, MN/MS of the resin is 2.3.

<Preparation of Binder Resin Particle Dispersion Liquid (4)>

| | |
|---|---|
| Styrene | 79 parts |
| n-butyl acrylate | 7.4 parts |
| Dimethyl aminoethyl acrylate | 13.6 parts |
| Acrylic acid | 1.8 parts |
| Dodecanethiol | 0.8 parts |
| Divinyl adipate | 0.6 parts |

A binder resin particle dispersion liquid (4) is prepared in the same manner as in the preparation of the binder resin particle dispersion liquid (1) except that the components are changed with the above components and an amount of sodium persulfate to be used is changed to 5 parts. The average particle diameter of the dispersion liquid is 210 nm, the solid content concentration is 40%, the glass transition temperature is 52° C., and the weight average molecular weight is 41,000. At this time, MN/MS of the resin is 9.6.

<Preparation of Binder Resin Particle Dispersion Liquid (5)>

| | |
|---|---|
| Styrene | 79 parts |
| n-butyl acrylate | 5.5 parts |
| Dimethyl aminoethyl acrylate | 15.5 parts |
| Acrylic acid | 1.8 parts |
| Dodecanethiol | 0.6 parts |
| Divinyl adipate | 0.5 parts |

A binder resin particle dispersion liquid (5) is prepared in the same manner as in the preparation of the binder resin particle dispersion liquid (1) except that the components are changed with the above components and an amount of sodium persulfate to be used is changed to 5 parts. The average particle diameter of the dispersion liquid is 230 nm, the solid content concentration is 40%, the glass transition temperature is 53° C., and the weight average molecular weight is 42,000. At this time, MN/MS of the resin is 14.5.

<Preparation of Binder Resin Particle Dispersion Liquid (6)>

| | |
|---|---|
| Styrene | 79 parts |
| n-butyl acrylate | 18.4 parts |
| Dimethyl aminoethyl acrylate | 2.6 parts |
| Acrylic acid | 1.8 parts |
| Dodecanethiol | 1.8 parts |
| Divinyl adipate | 0.7 parts |

A binder resin particle dispersion liquid (6) is prepared in the same manner as in the preparation of the binder resin particle dispersion liquid (1) except that the components are changed with the above components and an amount of sodium persulfate to be used is changed to 2.5 parts. The average particle diameter of the dispersion liquid is 230 nm, the solid content concentration is 40%, the glass transition temperature is 53° C., and the weight average-molecular weight is 30,000. At this time, MN/MS of the resin is 0.8.

<Preparation of Binder Resin Particle Dispersion Liquid (7)>

| | |
|---|---|
| Styrene | 79 parts |
| n-butyl acrylate | 4.4 parts |
| Dimethyl aminoethyl acrylate | 16.6 parts |
| Acrylic acid | 1.8 parts |
| Dodecanethiol | 0.6 parts |
| Divinyl adipate | 0.6 parts |

A binder resin particle dispersion liquid (7) is prepared in the same manner as in the preparation of the binder resin particle dispersion liquid (1) except that the components are changed with the above components and an amount of sodium persulfate to be used is changed to 5 parts. The average particle diameter of the dispersion liquid is 220 nm, the solid content concentration is 40%, the glass transition temperature is 51° C., and the weight average molecular weight is 43,000. At this time, MN/MS of the resin is 15.6.

<Preparation of Colorant Dispersion Liquid (1)>

| | |
|---|---|
| C.I. Pigment Yellow 74 (SEIKA FAST YELLOW 2054: manufactured by Dainichiseika Color & Chemicals mfg. Co., Ltd.) | 100 parts |
| Anion Surfactant (Neogen SC: manufactured by Dai-ichi Kogyo Seiyaku Co., Ltd.) | 10 parts |
| Ion-exchange water | 390 parts |

Above components are mixed and melted, and the mixture is dispersed by the use of a homogenizer (Ultra-Turrax: manufactured by IKA) for 20 minutes, thereby preparing a colorant dispersion liquid (1). The dispersion initiation temperature is 25° C. and the temperature at the time of termination of the dispersion is 41° C.

<Preparation of Colorant Dispersion Liquid (2)>

A colorant dispersion liquid (2) is prepared in the same manner as in the preparation of the colorant dispersion liquid (1) except that a colorant is changed with C. I. Pigment Red 122 (CHROMOFINE MAGENTA 6887: manufactured by Dainichiseika Color & Chemicals mfg. Co., Ltd.). The dispersion initiation temperature is 25° C. and the temperature at the time of termination of the dispersion is 41° C.

<Preparation of Colorant Dispersion Liquid (3)>

A colorant dispersion liquid (3) is prepared in the same manner as in the preparation of the colorant dispersion liquid (1) except that a colorant is changed with C. I. Pigment Blue 15:3 (CYANIN BLUE 4937: manufactured by Dainichiseika Color & Chemicals mfg. Co., Ltd.). The dispersion initiation temperature is 25° C. and the temperature at the time of termination of the dispersion is 42° C.

<Preparation of Colorant Dispersion Liquid (4)>

A colorant dispersion liquid (4) is prepared in the same manner as in the preparation of the colorant dispersion liquid (1) except that a colorant is changed with Carbon black (REGAL 330: manufactured by Cabot Corporation). The dispersion initiation temperature is 25° C. and the temperature at the time of termination of the dispersion is 41° C.

<Preparation of Release Agent Particle Dispersion Liquid (1)>

| | |
|---|---|
| Paraffin wax (HNP-9: manufactured by Nippon Seiro Co., Ltd.) | 100 parts |
| Anion surfactant (LIPAL 860K: manufactured by Lion Corporation) | 10 parts |
| Ion-exchange water | 290 parts |

Above components are mixed and melted, then the mixture is dispersed by the use of a homogenizer (Ultra-Turrax: manufactured by IKA), and further the mixture is subjected to a dispersion treatment by the use of a pressurized extrusion-type homogenizer under the conditions of 120° C. and 350 kg/cm$^2$ of pressure for 60 minutes, thereby preparing a release agent particle dispersion liquid (1) in which release agent particles (paraffin wax) having an average particle size of 200 nm is dispersed.

<Preparation of Release Agent Particle Dispersion Liquid (2)>

A release agent particle dispersion liquid (2) is prepared in the same manner as in the preparation of the release agent particle dispersion liquid (1) except that a paraffin wax is changed with an ester wax (EW-861: manufactured by Riken Vitamin Co., Ltd.). The average particle size thereof is 220 nm.

<Preparation of Release Agent Particle Dispersion Liquid (3)>

A release agent particle dispersion liquid (3) is prepared in the same manner as in the preparation of the release agent particle dispersion liquid (1) except that a paraffin wax is changed with a polyethylene wax (Polywax 725: manufactured by Toyo-Petrolite Co., Ltd.). The average particle size thereof is 240 nm.

(Preparation of Cyan Toner (1)>

| | |
|---|---|
| Binder resin particle dispersion liquid (1) | 320 parts |
| Colorant dispersion liquid (3) | 80 parts |
| Release agent particle dispersion liquid (2) | 96 parts |
| Aluminum sulfate (manufactured by WakoPure Chemical Industries, Ltd.) | 1.5 parts |
| Ion-exchange water | 1,290 parts |

Above components are stored into a round shaped stainless flask on which a jacket for controlling the temperature is attached, and dispersed for 5 min under 5,000 rpm by using a homogenizer (Ultra-Turrax T50: manufactured by IKA). Then, the mixture is transferred to the flask, and left while being stirred by four paddles at 25° C. for 20 min. After that, the mixture is heated by a mantle heater while being stirred up to 48° C. at the temperature increase rate of 1° C./min, and maintained for 20 min. at 48° C. Additionally, 80 parts of the binder resin particle dispersion liquid (1) is slowly introduced to the mixture, the mixture is maintained for 30 min. at 48° C., and 1 N of sodium hydroxide aqueous solution is added to the mixture to adjust pH to 6.5.

After that, the mixture is heated up to 95° C. at the temperature increase rate of 1° C./min and maintained for 30 min. 0.1 N of acetate aqueous solution is added to the mixture to adjust pH to 4.8 and the mixture is left at 95° C. for 2 hours. Then, 1 N of sodium hydroxide aqueous solution is added again to the mixture to adjust pH to 6.5 and the mixture is left at 95° C. for 5 hours. After that, the mixture is cooled down to 30° C. at the rate of 5° C./min.

The completed toner particle dispersion liquid is filtered. (A) 2,000 parts of ion-exchange water of 35° C. is added to the obtained toner particle, (B) the mixture is stirred and left for 20 min., and (C) the mixture is filtered. The process from (A) to (C) are repeated for 5 times and the toner particles on a filter paper are moved to a vacuum drying machine dried under the conditions of 40° C. and 1,000 Pa or below of pressure for 10 hours. The reason of setting the pressure to 1,000 Pa is that the pressure inside of the drying machine becomes irregular at the time of decompressing since the toner particles contains water so that moist is frozen at the early period of drying even under the temperature of 45° C. and then the moist is evaporated. However, after completing drying, the pressure is stabled to 100 Pa. After setting the pressure inside of the drying machine to normal pressure, the particles are extracted to obtain a mother particle of the toner. To 100 parts of the toner mother particle, 1.5 parts of titanium particles (T805: manufactured by Nippon Aerosil Co., Ltd., average particle diameter: 21 nm) and 2.3 part of hydrophobic silica (RX50: manufactured by Nippon Aerosil Co., Ltd., average particle size: 40 nm) are added, mixed by Henschel mixer under 3,000 rpm for 5 min, thereby obtaining a cyan toner (1).

The cyan toner (1) thus obtained has $D_{50v}$, of 5.7 μm, $GSD_p$ of 1.23, a glass transition temperature of 53° C., a shape factor SF1 of 123, and MN/MS of 7.5.

(Production of Magenta Toner (1))

A magenta toner (1) is produced in the same manner as in the production of the cyan toner (1) except that the colorant dispersion liquid (3) used in the production of the cyan toner (1) is changed with the colorant dispersion liquid (2) which is a magenta pigment.

The magenta toner (1) thus obtained has $D_{50v}$, of 5.8 μm, $GSD_p$ of 1.23, a glass transition temperature of 53° C., a shape factor SF1 of 122, and MN/MS of 7.5.

(Production of Yellow Toner (1))

A yellow toner (1) is produced in the same manner as in the production of the cyan toner (1) except that the colorant dispersion liquid (3) used in the production of the cyan toner (1) is changed with the colorant dispersion liquid (1) which is a yellow pigment.

The yellow toner (1) thus obtained has $D_{50v}$, of 5.7 μm, $GSD_p$ of 1.23, a glass transition temperature of 53° C., a shape factor SF1 of 124, and MN/MS of 7.5.

(Production of Black Toner (1))

A black toner (1) is produced in the same manner as in the production of the cyan toner (1) except that the colorant dispersion liquid (3) used in the production of the cyan toner (1) is changed with the colorant dispersion liquid (4) which is a black pigment.

The black toner (1) thus obtained has $D_{50v}$, of 5.7 μm, $GSD_p$ of 1.23, a glass transition temperature of 53° C., a shape factor SF1 of 122, and MN/MS of 7.5.

(Production of Cyan Toner (2))

A cyan toner (2) is produced in the same manner as in the production of the cyan toner (1) except that the binder resin particle dispersion liquid (1) used in the production of the cyan toner (1) is changed with the binder resin particle dispersion liquid (2).

The cyan toner (2) thus obtained has $D_{50v}$, of 6.0 μm, $GSD_p$ of 1.23, a glass transition temperature of 53° C., a shape factor SF1 of 116, and MN/MS of 1.2.

(Production of Cyan Toner (3))

A cyan toner (3) is produced in the same manner as in the production of the cyan toner (1) except that the binder resin particle dispersion liquid (1) used in the production of the cyan toner (1) is changed with the binder resin particle dispersion liquid (3).

The cyan toner (3) thus obtained has $D_{50v}$, of 6.2 μm, $GSD_p$ of 1.24, a glass transition temperature of 53° C., a shape factor SF1 of 120, and MN/MS of 2.3.

(Production of Cyan Toner (4))

A cyan toner (4) is produced in the same manner as in the production of the cyan toner (1) except that the binder resin particle dispersion liquid (1) used in the production of the cyan toner (1) is changed with the binder resin particle dispersion liquid (4) which is a magenta pigment.

The cyan toner (4) thus obtained has $D_{50v}$, of 5.9 μm, $GSD_p$ of 1.23, a glass transition temperature of 52° C., a shape factor SF1 of 130, and MN/MS of 9.6.

(Production of Cyan Toner (5))

A cyan toner (5) is produced in the same manner as in the production of the cyan toner (1) except that the binder resin particle dispersion liquid (1) used in the production of the cyan toner (1) is changed with the binder resin particle dispersion liquid (5) which is a magenta pigment.

The cyan toner (5) thus obtained has $D_{50v}$, of 5.3 μm, $GSD_p$ of 1.23, a glass transition temperature of 53° C., a shape factor SF1 of 136, and MN/MS of 14.5.

(Production of Cyan Toner (6))

A cyan toner (6) is produced in the same manner as in the production of the cyan toner (1) except that the binder resin particle dispersion liquid (1) used in the production of the cyan toner (1) is changed with the binder resin particle dispersion liquid (6) which is a magenta pigment.

The cyan toner (6) thus obtained has $D_{50v}$, of 5.5 μm, $GSD_p$ of 1.24, a glass transition temperature of 53° C., a shape factor SF1 of 123, and MN/MS of 0.8.

(Production of Cyan Toner (7))

A cyan toner (7) is produced in the same manner as in the production of the cyan toner (1) except that the binder resin particle dispersion liquid (1) used in the production of the cyan toner (1) is changed with the binder resin particle dispersion liquid (7) which is a magenta pigment.

The cyan toner (7) thus obtained has $D_{50v}$, of 5.3 μm, $GSD_p$ of 1.32, a glass transition temperature of 50° C., a shape factor SF1 of 130, and MN/MS of 15.6.

(Production of Cyan Toner (8))

The temperature condition used in the production of the cyan toner (1) is set to the temperature increase rate of 1° C./min, and the temperature is increased up to 98° C. and maintained for 30 minutes. 0.1 N of nitrate aqueous solution is added to the mixture to adjust pH to 4.2 and the mixture is left at 98° C. for 4 hours. After that, a cyan toner (8) is produced in the same manner as in the production of the cyan toner (1) except that 1 N of sodium hydroxide aqueous solution is added to the mixture to adjust pH to 6.5 and the mixture is left at 98° C. for 2 hours.

The cyan toner (8) thus obtained has $D_{50v}$, of 5.6 μm, $GSD_p$ of 1.22, a glass transition temperature of 52° C., a shape factor SF1 of 108, and MN/MS of 7.5.

(Production of Cyan Toner (9))

The temperature condition used in the production of the cyan toner (1) is set to the temperature increase rate of 1° C./min, and the temperature is increased up to 85° C. and maintained for 30 minutes. 0.1 N of nitrate aqueous solution is added to the mixture to adjust pH to 5.5 and the mixture is left at 85° C. for 2 hours. After that, a cyan toner (9) is produced in the same manner as in the production of the cyan toner (1) except that 1 N of sodium hydroxide aqueous solution is added to the mixture to adjust pH to 6.5 and the mixture is left at 85° C. for 3 hours.

The cyan toner (9) thus obtained has $D_{50v}$, of 5.8 μm, $GSD_p$ of 1.24, a glass transition temperature of 52° C., a shape factor SF1 of 147, and MN/MS of 7.5.

(Production of Cyan Toner (10))

A cyan toner (10) is produced in the same manner as in the production of the cyan toner (1) except that the release agent particle dispersion liquid (2) used in the production of the cyan toner (1) is changed with the release agent particle dispersion liquid (1).

The cyan toner (10) thus obtained has $D_{50v}$, of 5.5 μm, $GSD_p$ of 1.23, a glass transition temperature of 53° C., a shape factor SF1 of 122, and MN/MS of 7.5.

(Production of Cyan Toner (11))

A cyan toner (11) is produced in the same manner as in the production of the cyan toner (1) except that the release agent particle dispersion liquid (2) used in the production of the cyan toner (1) is changed with the release agent particle dispersion liquid (3).

The cyan toner (11) thus obtained has $D_{50v}$, of 5.7 μm, $GSD_p$ of 1.22, a glass transition temperature of 53° C., a shape factor SF1 of 125, and MN/MS of 7.5.

(Production of Cyan Toner (12))

A cyan toner (12) is produced in the same manner as in the production of the cyan toner (1) except that hydrophobic silica particles (RX50: manufactured by Nippon Aerosil Co., Ltd., average particle size: 40 nm) used in the production of the cyan toner (1) is not added to the mixture.

The cyan toner (12) thus obtained has $D_{50v}$, of 5.7 μm, $GSD_p$ of 1.23, a glass transition temperature of 53° C., a shape factor SF1 of 122, and MN/MS of 7.5.

(Production of Cyan Toner (13))

A cyan toner (13) is produced in the same manner as in the production of the cyan toner (1) except that titanium particles (T805: manufactured by Nippon Aerosil Co., Ltd., average particle size of 21 nm) used in the production of the cyan toner (1) is not added to the mixture.

The cyan toner (13) thus obtained has $D_{50v}$, of 5.7 μm, $GSD_p$ of 1.23, a glass transition temperature of 53° C., a shape factor SF1 of 122, and MN/MS of 7.5.

<Preparation of Carrier 1>

To a kneader, 1,000 parts of Mn—Mg ferrite (average particle size of 50 μm, manufactured by Powder Tech, shape factor SF1 of 120) and a solution in which 150 parts of copolymer of perfluorooctyl methylacrylate-methylmethacrylate (polymerization ratio of 20:80, Tg of 72° C., weight average molecular weight of 72,000, manufactured by Soken Chemical & Engineering Co., Ltd.) is melted in 700 parts of toluene are added and mixed at the room temperature for 20 minutes. After that, the mixture is overheated to 70° C., dried under reduced pressure, and then extracted to obtain a coated carrier. The coated carrier thus obtained is sieved to a mesh of 75 μm opening to remove coarse powders, thereby obtaining a carrier 1.

A shape factor SF1 of the carrier 1 is 122.

<Preparation of Carrier 2>

A carrier 2 is prepared in the same manner as in the preparation of the carrier 1 except that a copolymer of styrene-methyl methacrylate (polymerization ratio of 75:25, Tg of 95° C., weight average molecular weight of 78,000, manufactured by Mitsubishi Rayon Co., Ltd.) is used instead of the copolymer of perfluorooctyl methylacrylate-methylmethacrylate.

A shape factor SF1 of the carrier 2 is 122.

<Preparation of Carrier 3>

A carrier 3 is prepared in the same manner as in the preparation of the carrier 1 except that a ferrite having the average particle size of 47 μm (manufactured by Powder Tech, shape factor SF1 of 110) is used instead of the ferrite having the average particle size of 50 μm (manufactured by Powder Tech, shape factor SF1 of 120) used in the preparation of the carrier 1.

A shape factor SF1 of the carrier 3 is 113.

<Preparation of Carrier 4>

A carrier 4 is prepared in the same manner as in the preparation of the carrier 1 except that a ferrite having the average particle size of 52 μm (manufactured by Powder Tech, shape factor SF1 of 126) is used instead of the ferrite having the average particle-size of 50 μm (manufactured by Powder Tech, shape factor SF1 of 120) used in the preparation of the carrier 1.

A shape factor SF1 of the carrier 4 is 128.

<Preparation of Carrier 5>

A carrier 5 is prepared in the same manner as in the preparation of the carrier 1 except that a ferrite having the average particle size of 56 μm (manufactured by Powder Tech, shape factor SF1 of 132) is used instead of the ferrite having the average particle size of 50 μm (manufactured by Powder Tech, shape factor SF1 of 120) used in the preparation of the carrier 1.

A shape factor SF1 of the carrier 5 is 135.

<Preparation of Developer>

Each of the carriers 1 to 5 is combined with the cyan toners 1 to 13, the magenta toner 1, and the yellow toner 1 as shown in Table 1 in the weight ratio of 95:5. The mixtures are put in a V blender and stirred for 20 minutes, thereby obtaining a developer for an electrophotography.

TABLE 1

| Developer | Toner | Carrier | Toner SF1 | MN/MS | Carrier SF1 |
|---|---|---|---|---|---|
| Developer 1 | Cyan toner 1 | Carrier 1 | 123 | 7.5 | 122 |
| Developer 2 | Magenta Toner 1 | Carrier 1 | 122 | 7.5 | 122 |
| Developer 3 | Yellow Toner 1 | Carrier 1 | 124 | 7.5 | 122 |
| Developer 4 | Black Toner 1 | Carrier 1 | 122 | 7.5 | 122 |
| Developer 5 | Cyan toner 2 | Carrier 1 | 116 | 1.2 | 122 |
| Developer 6 | Cyan toner 3 | Carrier 1 | 120 | 2.3 | 122 |
| Developer 7 | Cyan toner 4 | Carrier 1 | 130 | 9.6 | 122 |
| Developer 8 | Cyan toner 5 | Carrier 1 | 136 | 14.5 | 122 |
| Developer 9 | Cyan toner 6 | Carrier 1 | 123 | 0.8 | 122 |
| Developer 10 | Cyan toner 7 | Carrier 1 | 130 | 15.6 | 122 |
| Developer 11 | Cyan toner 8 | Carrier 1 | 108 | 7.5 | 122 |
| Developer 12 | Cyan toner 9 | Carrier 1 | 147 | 7.5 | 122 |
| Developer 13 | Cyan toner 10 | Carrier 1 | 122 | 7.5 | 122 |
| Developer 14 | Cyan toner 11 | Carrier 1 | 125 | 7.5 | 122 |
| Developer 15 | Cyan toner 12 | Carrier 1 | 122 | 7.5 | 122 |
| Developer 16 | Cyan toner 13 | Carrier 1 | 122 | 7.5 | 122 |
| Developer 17 | Cyan toner 1 | Carrier 2 | 123 | 7.5 | 122 |
| Developer 18 | Cyan toner 1 | Carrier 3 | 123 | 7.5 | 113 |
| Developer 19 | Cyan toner 1 | Carrier 4 | 123 | 7.5 | 128 |
| Developer 20 | Cyan toner 1 | Carrier 5 | 123 | 7.5 | 135 |

<Evaluation>

The developers 1 to 20 shown in Table 1 are stored into a developing machine for cyan development in a modified DocuCentre Color f450 machine manufactured by Fuji Xerox Co., Ltd. and the toner carrying amount of the machine is adjusted to be 3 g/m$^2$. The DocuCentre Color f450 is modified to be operated even when a developer is not stored in the other developing machines. As for a paper, J paper (A3 size) manufactured by Fuji Xerox Co., Ltd. is used. 99 sheets of image are successively printed out by using the amount of the toner carried in the machine. After that, a white paper without an image is printed and the toner (so called, fogged toner) shown on the paper is evaluated with eyes.

Evaluation is finished when the fogged toner is appeared and the number of papers at that point of time is recorded. The maximum number of test papers is set to 20,000 sheets. When the fogged toner is not appeared until 20,000 sheets of printing, the evaluation is determined as 20,000 sheets or more.

The targeted number of papers is set to 15,000 and when the number of papers exceeded 15,000 or more, it is assumed that there is no problem.

In addition, as for the environment, a winter environment (10° C., 15%) and a summer environment (30° C., 85%) are repeated every 2,500 sheets and repeated until 20,000 sheets. That is, the papers in the range of 1 st to 2,500 th sheets, 5,001 st to 7,500 th sheets, 10,001 st to 12,500 th sheets, and 15,001 st to 17,500 th sheets are in the winter environment; and the papers in the range of 2,501 st to 5,000 th sheets, 7,501 st to 10,000 th sheets, 12,501 st to 15,000 th sheets, and 17,501 st to 20,000 th sheets are in the summer environment.

The ratio of the toner relative to the entire developer is 95:5 by the weight ratio only at the early stage as mentioned above. After that, the ratio is controlled by the amount of the toner carried on the papers.

At the time of changing the exterior environment, only the developing machine in the DocuCentre Color f450 is put in a polyethylene bag not to be exposed to the air, sealed, and lefted in the other side of environment for 12 hours.

After that, the developing machine is taken out of the bag and installed again to the DocuCentre Color f450 and the evaluation is continued.

Examples

The results of Examples 1 to 18 and Comparative Examples 1 and 2 which used the developers 1 to 20 are represented in Table 2. The fog is not generated until 12,500 sheets of printing in both Examples and Comparative Examples.

According to the results in Table 2, the followings are confirmed. That is, in Examples 1 to 18, since a variation in the charging amount is small even in the summer environment and winter environment, the fog is hardly generated as a result. On the contrary, the fogged toner is generated when MN/MS is below 1.0 and 15 or higher as shown in Comparative Examples 1 and 2.

In addition, when the toner having the shape factor in the suitable range is used, an effect of the charging amount due to the friction where the toner is contacted is in the preferable range, thereby increasing the effect of the invention. Further, when the shape factor of the carrier is in the suitable range, the contact with the toner becomes preferable, thereby improving the effect of the charging amount.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A toner for developing an electrostatic charge image, the toner comprising:

a binder resin formed by reacting a polymerizable aromatic monomer having an ethylenically unsaturated double

TABLE 2

| | | Fog generation status | | | | |
|---|---|---|---|---|---|---|
| | Developer | 1st to 12,500th sheets | 12,501st to 15,000th sheets Summer Environment | 15,001st to 17,500th sheets Winter Environment | 17,501st to 20,000th sheets Summer Environment | Remark |
| Ex. 1 | Developer 1 | Not generated | Not generated | Not generated | Not generated | 20,000 sheets or more |
| Ex. 2 | Developer 2 | Not generated | Not generated | Not generated | Not generated | 20,000 sheets or more |
| Ex. 3 | Developer 3 | Not generated | Not generated | Not generated | Not generated | 20,000 sheets or more |
| Ex. 4 | Developer 4 | Not generated | Not generated | Not generated | Not generated | 20,000 sheets or more |
| Ex. 5 | Developer 5 | Not generated | Not generated | 15,800th sheet | — | |
| Ex. 6 | Developer 6 | Not generated | Not generated | Not generated | 18,600th sheet | |
| Ex. 7 | Developer 7 | Not generated | Not generated | Not generated | 19,100th sheet | |
| Ex. 8 | Developer 8 | Not generated | Not generated | Not generated | 17,700th sheet | |
| Ex. 9 | Developer 11 | Not generated | Not generated | Not generated | 19,000th sheet | |
| Ex. 10 | Developer 12 | Not generated | Not generated | Not generated | 17,900th sheet | |
| Ex. 11 | Developer 13 | Not generated | Not generated | Not generated | 19,500th sheet | |
| Ex. 12 | Developer 14 | Not generated | Not generated | Not generated | 19,800th sheet | |
| Ex. 13 | Developer 15 | Not generated | Not generated | Not generated | 18,500th sheet | |
| Ex. 14 | Developer 16 | Not generated | Not generated | Not generated | 18,900th sheet | |
| Ex. 15 | Developer 17 | Not generated | Not generated | 16,700th sheet | — | |
| Ex. 16 | Developer 18 | Not generated | Not generated | Not generated | 19,000th sheet | |
| Ex. 17 | Developer 19 | Not generated | Not generated | Not generated | Not generated | 20,000 sheets or more |
| Ex. 18 | Developer 20 | Not generated | Not generated | Not generated | 18,800th sheet | |
| Comp. Ex. 1 | Developer 9 | Not generated | 13,700th sheet | — | — | |
| Comp. Ex. 2 | Developer 10 | Not generated | 14,000th sheet | — | — | |

bond conjugated to an aromatic ring thereof, a nitrogen-containing polymerizable aliphatic monomer having an ethylenically unsaturated double bond and a sulfur-containing aliphatic compound to each other; and a colorant, wherein a ratio (MN/MS) of an amount of nitrogen (MN) to an amount of sulfur (MS) is in a range of from 1.0 to 15.

2. The toner according to claim 1, which has a number average particle size distribution index GSDp represented by the following formula of 1.40 or less:

$$GSDp=\{(D_{84p})/(D_{16p})\}^{0.5}.$$

3. The toner according to claim 1, which has a shape factor SF1 in a range of from 110 to 145.

4. The toner according to claim 1, wherein the sulfur-containing aliphatic compound is a compound having a thiol component.

5. The toner according to claim 1, wherein the sulfur-containing aliphatic compound is an alkylmercaptane having 6 to 12 carbon atoms.

6. The toner according to claim 1, wherein the binder resin further comprises a cross-linking agent in an amount range of from 0.05 to 5% by weight relative to the total amount of polymerizable monomers.

7. The toner according to claim 1, wherein an amount of the colorant is in a range of from 4 to 15% by weight relative to the total amount of a solid content of the toner.

8. The toner according to claim 1, which further comprises:

a release agent in an amount range of from 1 to 20% by weight relative to the total amount of a solid content of the toner.

9. An electrostatic charge image developer comprising:

a carrier; and a toner according to claim 1, wherein the carrier comprises a magnetic powder and a resin having a fluorine atom.

10. The electrostatic charge image developer according to claim 9, which has a shape factor SF1 in a range of from 110 to 145.

11. The electrostatic charge image developer according to claim 9, wherein the resin having a fluorine atom is a polymer of at least one of an acrylate ester compound and a methacrylate ester compound.

12. The toner according to claim 1, wherein the ratio (MN/MS) of an amount of nitrogen (MN) to an amount of sulfur (MS) is in a range of from 2.0 to 10.

13. The toner according to claim 12, which has a number average particle size distribution index GSDp represented by the following formula of 1.31 or below:

$$GSDp=\{(D_{84p})/(D_{16p})\}^{0.5}.$$

14. The toner according to claim 12, which has a shape factor SF1 in a range of from 120 to 140.

15. An electrostatic charge image developer comprising:

a carrier; and a toner according to claim 12, wherein the carrier comprises a magnetic powder and a resin having a fluorine atom.

16. The electrostatic charge image developer according to claim 15, which has a shape factor SF1 in a range of from 120 to 140.

17. The electrostatic charge image developer according to claim 15, wherein the resin having a fluorine atom is a polymer of at least one of an acrylate ester compound and a methacrylate ester compound.

18. An image forming method comprising:

forming an electrostatic latent image on a surface of a latent image carrier;

developing the electrostatic latent image formed on the surface of the latent image carrier by a developer containing a toner to form a toner image;

transferring the toner image formed on the surface of the latent image carrier to a surface of a transfer member; and heat fixing the toner image transferred to the surface of the transfer member, wherein the developer is an electrostatic charge image developer according to claim 9.

19. An image forming apparatus comprising:

a latent image carrier;

a charging unit that charges the latent image carrier;

an exposing unit that exposes the charged latent image carrier to form an electrostatic latent image on the latent image carrier;

a developing unit that develops the electrostatic latent image by a developer to form a toner image; and a transferring unit that transfers the toner image from the latent image carrier to a recording material, wherein the developer is an electrostatic charge image developer according to claim 9.

* * * * *